US005560545A

United States Patent [19]

Grogan et al.

[11] Patent Number: 5,560,545

[45] Date of Patent: Oct. 1, 1996

[54] DUAL IN-LINE TRIGGER SPRAYER

[75] Inventors: R. Pat Grogan, Downey; James R. Gillingham, Hacienda Heights; Tanny Li, Walnut, all of Calif.

[73] Assignee: Calmar Inc., City of Industry, Calif.

[21] Appl. No.: 332,593

[22] Filed: Oct. 31, 1994

[51] Int. Cl.[6] ..... B05B 7/02; B05B 9/043; B05B 7/24

[52] U.S. Cl. ..... 239/304; 239/333; 239/399; 239/418; 239/526; 222/136; 222/145.1; 222/384; 222/153.13

[58] Field of Search ..... 239/399, 401, 239/422.5, 526, 330–333, 304, 418; 417/521; 222/145.1, 145.5, 383.1, 384, 372, 136, 153.13

[56] References Cited

U.S. PATENT DOCUMENTS

| | | | |
|---|---|---|---|
| 1,111,689 | 9/1914 | Dolan | 239/399 X |
| 3,226,035 | 12/1965 | Jokelson | 417/521 X |
| 3,741,443 | 6/1973 | Marand | 222/145.5 X |
| 3,760,986 | 9/1973 | Castner et al. . | |
| 3,780,951 | 12/1973 | Powers . | |
| 3,786,963 | 1/1974 | Metzler, III . | |
| 3,836,079 | 9/1974 | Huston | 239/347 X |
| 3,884,388 | 5/1975 | Holcomb | 222/145.5 X |
| 4,355,739 | 10/1982 | Vierkötter . | |
| 5,009,342 | 4/1991 | Lawrence et al. . | |
| 5,152,461 | 10/1992 | Proctor . | |
| 5,332,157 | 7/1994 | Proctor . | |
| 5,385,270 | 1/1995 | Cataneo et al. | 222/145.5 |

FOREIGN PATENT DOCUMENTS

| | | | |
|---|---|---|---|
| 1052544 | 3/1952 | France | 417/521 |
| 2641337 | 7/1990 | France | 222/145.5 |

*Primary Examiner*—Kevin P. Weldon

*Attorney, Agent, or Firm*—Watson Cole Stevens, Davis, P.L.L.C.

[57] ABSTRACT

A fluid dispenser for simultaneously dispensing disparate fluids separately stored in separate fluid compartments of a container includes a single pump cylinder defining together with a dual seal piston a pair of in-line pump chambers for separately and simultaneously pumping the disparate fluids along separate discharge paths.

21 Claims, 2 Drawing Sheets

DUAL IN-LINE TRIGGER SPRAYER

BACKGROUND OF THE INVENTION

This invention relates generally to a fluid dispenser for simultaneously dispensing different fluids separately stored in different fluid compartments, and more particularly, to such a dispenser having a single pump piston and cylinder arrangement defining separate in-line pump chambers for simultaneously and separately pumping the disparate fluids.

The dispenser has a container vent control in the form of a rotatable ring, and a child-resistant feature including a bar removably connected at one end to the ring and bearing against the inside face of a trigger actuator for preventing trigger actuation and for locking the vent control ring in a vent closed condition.

Many dispensing packages are known for the dispensing of different fluids separately stored in a container or containers to which the dispenser is mounted. Typically, the different fluids are suctioned into a common chamber of a single pump cylinder for dispensing upon pump operation, as represented by U.S. Pat. Nos. 3,786,963, 4,355,739 and 5,009,342. Standard trigger-operated or fingertip pumps are provided for pumping the mixed fluids from the common pump chamber.

Otherwise, U.S. Pat. Nos. 5,332,157 and 5,152,461 provide a common pump chamber for the disparate fluids as part of the fluid dispensing head.

Improvements in the known dispensers of disparate fluids are desirable for reducing the complexity of the dispensing package while increasing the efficiency of operation and reducing the cost of fabrication and assembly.

SUMMARY OF THE INVENTION

It is an object of the present invention to provide a fluid dispenser for simultaneously pumping and spraying disparate liquids stored separately, by pumping the fluids along separate paths toward the discharge nozzle, in which the fluids are swirled to effect a spray discharge in a combined or separate spray patterns. The disparate fluids are separately pumped utilizing a single pump cylinder defining separate pump chambers for each of two fluids, the chambers being defined by a single pump piston having axially spaced pump seals.

The pump chambers may be of equal capacity for pumping and spraying equal proportions of the disparate fluids, or the pump chambers may be of unequal capacity for the pumping and spraying of disproportionate amounts of disparate fluids. The pump chambers have fluid inlets respectively communicating with separate valve controlled inlet passages leading from separate fluid compartments, and the pump chambers have fluid outlets respectively communicating with separate fluid discharge passages leading to the discharge nozzle.

Container vent openings are located in the body of the pump respectively in communication with the fluid compartments, and a vent control ring is provided on the pump body for rotation about its central axis without movement along that axis for blocking and unblocking the vent openings upon manual rotation by misaligning apertures in the control ring with the vent openings and aligning those apertures with the vent openings upon ring rotation.

The present dispenser is of the trigger-actuated type and may have a child-resistant feature in the form of a bar removably connected at one end to the control ring in the vent blocking position, and bearing at its opposite end against the underside of the trigger lever. The bar prevents trigger actuation and locks the vent control ring in a non-use condition of the dispenser, and removal of the bar permits rotation of the vent control ring to its vent opening unblocking position.

Other objects, advantages and novel features of the invention will become more apparent from the following detailed description of the invention when taken in conjunction with the accompanying drawings.

DETAILED DESCRIPTION OF THE INVENTION

Figure 1:
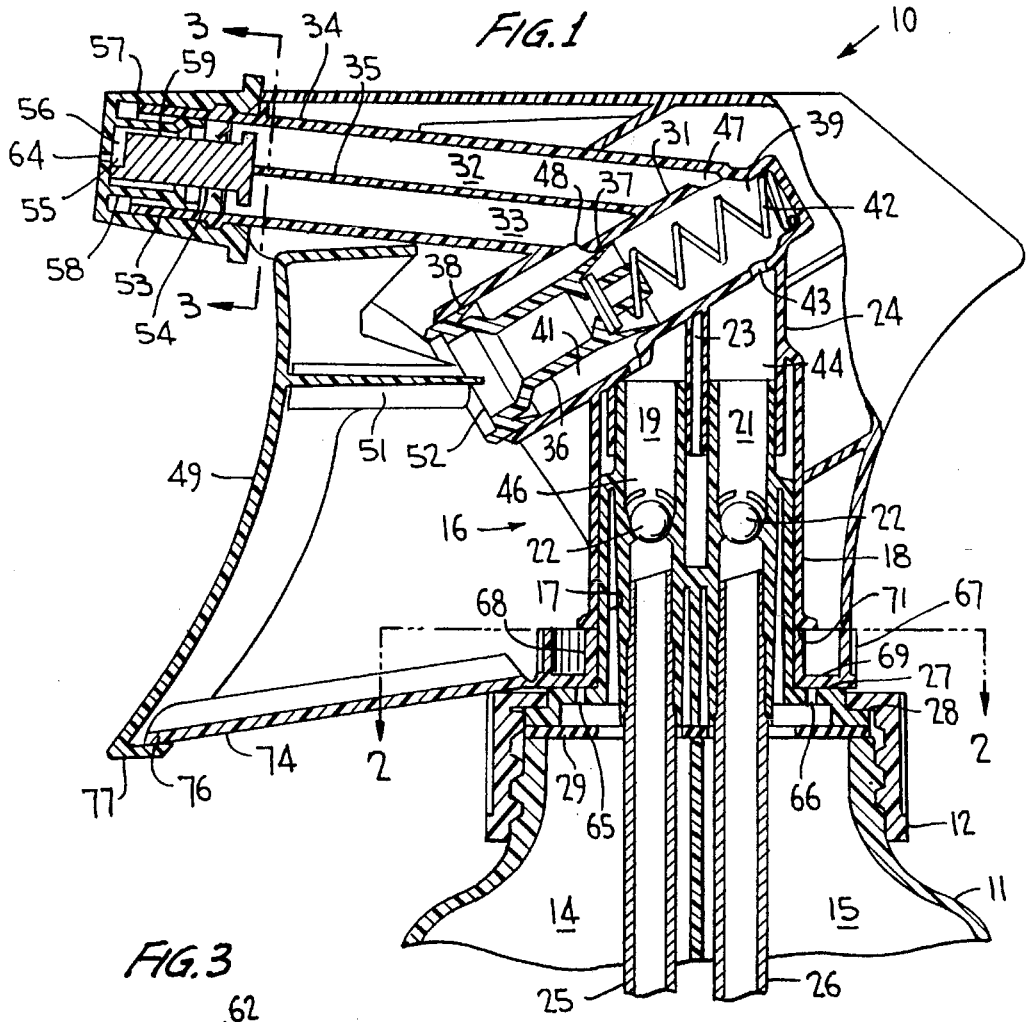
FIG. 1 is a side elevational view, mostly in section, of a trigger-actuated dispenser incorporating the invention.

Referring now to the drawings wherein like reference characters refer to like and corresponding parts throughout the several views, dispenser 10 incorporating the invention is mounted to a container 11 using a threaded closure cap 12. The container has a vertical separator wall 13 defining separate compartments 14 and 15, each for separately storing a disparate fluid. Otherwise, the container may be split into halves forming a common threaded neck between the two halves, each half container defining a separate compartment for the disparate fluids.

Pump body 16 of the dispenser includes an inner cylinder 17 and a neck portion 18 fitted within the cylinder in some normal manner. The neck portion has two tubes 19 and 21 each containing an inlet ball check valve 22, the upper ends of the tubes sealing engaging within depending sleeves 23 and 24 of the pump body. The lower ends of the tubes support depending dip tubes 25 and 26, respectively extending into compartments 14 and 15 below the level of each fluid contained in each compartment.

Neck portion 18 has at its lower end an annular shoulder 27 and an annular flange 28, the closure cap engaging flange 28 to facilitate mounting the dispenser on the container with the provision of an intervening disc seal 29.

Figure 3:
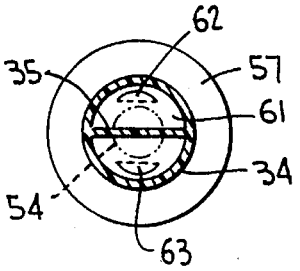
FIG. 3 is a view taken substantially along the line 3—3 of FIG. 1.

The pump body includes a single pump cylinder 31 disposed at a suitable angle to the central axis of the pump body and its closure cap. Extending from the cylinder are upper and lower discharge passages 32 and 33, which may be defined by a circular tube barrel 34 divided by a horizontal wall 35 (FIG. 3). Otherwise each of the passages 32 and 33 may be defined by separate discharge tubes.

A pump piston 36 is mounted for reciprocation within cylinder 31, the piston having axially spaced piston seals 37 and 38, which define together with the piston cylinder a pair of separate and axially aligned variable volume pump chambers 39 and 41. A return spring 42 may be provided in chamber 39 for spring biasing the piston in the direction outwardly of the cylinder.

Pump chamber 39 has an inlet port 43 in communication with its inlet passage 44, and pump chamber 41 has an inlet port 45 in communication with its inlet passage 46. And, the pump chambers have outlet ports 47 and 48, respectively in communication with discharge passages 32 and 33.

A trigger lever 49 is pivotally connected at its upper end to the pump body in some normal manner, and has a rearwardly extending tup 51 engaging outer rim 52 of the piston for manually reciprocating the piston against the force of the return spring as in the normal manner. The lever is channel shaped in section, having spaced side walls 50 extending rearwardly from its front wall.

The discharge or nozzle end 53 of discharge barrel 34 has mounted therein a spinner probe 54 having at its outer end tangential channels 55 extending into a spin chamber 56 of known construction. A nozzle cap 57 is snap-fitted about nozzle 53, and has an inner skirt 58 sealed against the inner surface of nozzle 53 and defining together with the spinner probe longitudinal channels 59 communicating with the tangentials. Such a fluid spin mechanics assembly is disclosed in U.S. Pat. No. 4,706,888, commonly owned herewith.

An elastomeric discharge valve disc 61 is mounted within the nozzle and may surround the probe. The valve disk has one-way flap valves 62 and 63 (FIG. 3) respectively valving the flow of fluid from discharge passages 32 and 33 to the nozzle. And, nozzle cap 57 has a discharge orifice 64 in communication with spin chamber 56.

As shown in FIG. 1, shoulder 27 of neck portion 18 has a vent opening 65 in communication with storage compartment 14, and has a vent opening 66 in communication with storage compartment 15. A vent control ring 67 surrounds neck portion 18, and has an upstanding wall 68 and a bottom wall 69. Lower edge 71 of internal cylinder 17 bears against the upper end of the control ring for pressing lower wall 69 of the control ring against shoulder 27.

Figure 2:
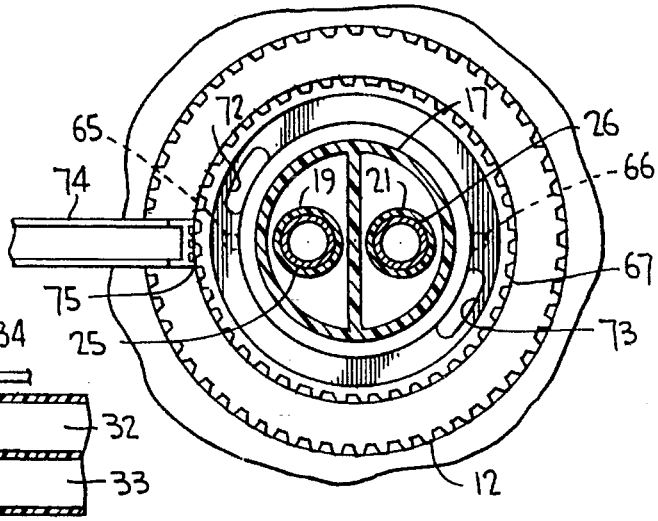
FIG. 2 is a view taken substantially along the line 2—2 of FIG. 1.

Lower wall 69 has a pair of apertures 72, 73 therein, which may be elongated as shown in FIG. 2, for alignment with vent openings 65 and 66 to open the container vents upon manual rotation of the vent control ring as to be hereinafter described.

In accordance with another feature of the invention, the trigger sprayer may be rendered child-resistant by the provision of a bar 74 removably connected at one end to the vent control ring via frangible connecting ties 75 (FIG. 2), and bearing at its other end 76 against the inner surface of the trigger lever between walls 50 and being retained in place by a catch 77 extending inwardly of the lever.

Bar 74 is connected to the vent control ring in its rotated position of FIG. 2, in which the ring blocks vent openings 65 and 66 in a non-use condition of the dispenser as during shipping, storage and display. Bar 74 prevents trigger actuation in such non-use condition and locks the control ring in its vent closed position to avoid leakage through the vent openings.

In operation, bar 74 is simply removed by breaking the frangible connecting ties, and the vent control ring is rotated to a position of alignment respectively between apertures 72,73 and vent openings 65,66 to prevent hydraulic lock during pumping. Once pump chambers 39 and 41 are primed with disparate fluids in the form of liquid products (which may be water and a household cleansing agent) suctioned into the pump chambers from compartments 14 and 15 via the inlet passages, each pressure stroke of the piston simultaneously and separately pumps the fluids along separate discharge paths 32 and 33 such that the pressurized fluids are forced through valves 62 and 63 for mixing at the downstream side of the discharge valve. The combined fluids swirl together in the spin chamber and are discharged through the discharge orifice as a spray of combined fluids.

On each piston return stroke, the discharge valves close to facilitate priming as the disparate products from compartments 14 and 15 are suctioned via inlet passages 44 and 46 and inlet ports 43 and 44 into their respective pump chambers, to be maintained separated therein as well as during the ensuing pumping action as the separate fluids are discharged along passages 32 and 33 and into the spin mechanics as afore-described.

Pump chambers 39 and 41 can be of equal capacity for dispensing equal amounts of disparate fluids during pumping, or one of the pump chambers can be of lesser capacity compared to the other for dispensing disproportionate amounts of disparate fluids during pumping.

Figure 4:
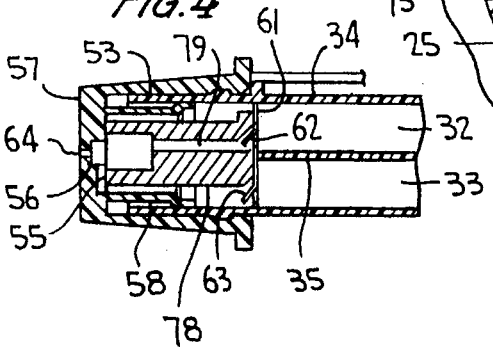
FIG. 4 is a sectional view at the nozzle end of the dispenser showing another embodiment for effecting spray discharge.

Other variations at the discharge nozzle end of the dispenser are made possible according to the invention. For example, as shown in FIG. 4, probe 78 may have a longitudinal passage 79 communicating with spin chamber 56 located in the confronting wall of nozzle cap 57 which likewise contains tangential channels 55. Discharge valve disc 61 has its one-way flap valve 62 for valving flow of fluid from passage 32 through opening 78, and has its one-way flap valve 63 for valving fluid from passage 33 to tangentials 55 and into spin chamber 56. Thus, the flow of disparate fluids remains separated until the fluids combine in the spin chamber, at which the fluids are swirled to issue through the discharge orifice as a spray. The FIG. 4 arrangement is similar to that disclosed in U.S. Application Ser. No. 08/326,230, filed Oct. 20, 1994, entitled SPRAYER HAVING VARIABLE SPRAY PATTERN, and commonly owned herewith. As more fully described in that application, flow of fluid, in this case fluids, both through the spinner probe and around the probe, have the effect of controlling the conicity of the spray issuing through the discharge orifice as the fluid flowing through passage 79 negates some of the spin velocity of the fluid passing through the tangentials to thereby produce a spray of a lesser conical angle.

Figure 5:
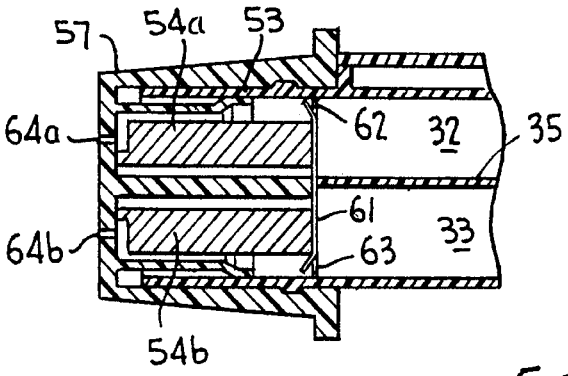
FIG. 5 is a view similar to FIG. 4 showing a further embodiment for effecting spray discharge.

As shown in FIG. 5, spinner probes **54*a* and 54*b*, each similar to probe 54 described with reference to FIG. 1, are mounted within discharge nozzle 53 respectively associated with discharge passages 32 and 33. Nozzle cap 57 has discharge orifices 64*a* and 64*b* respectively in communication with the spin chambers of the two probes, and discharge valve disc 61 has its valves 62 and 63 respectively for valving the disparate fluids from passages 32 and 33** into the respective spin mechanics.

Thus, the disparate fluids are separately swirled and are discharged through their orifices **64*a* and 64*b*** as spray cones to be mixed and combined downstream of the nozzle cap before reaching the spray target.

Figure 6:
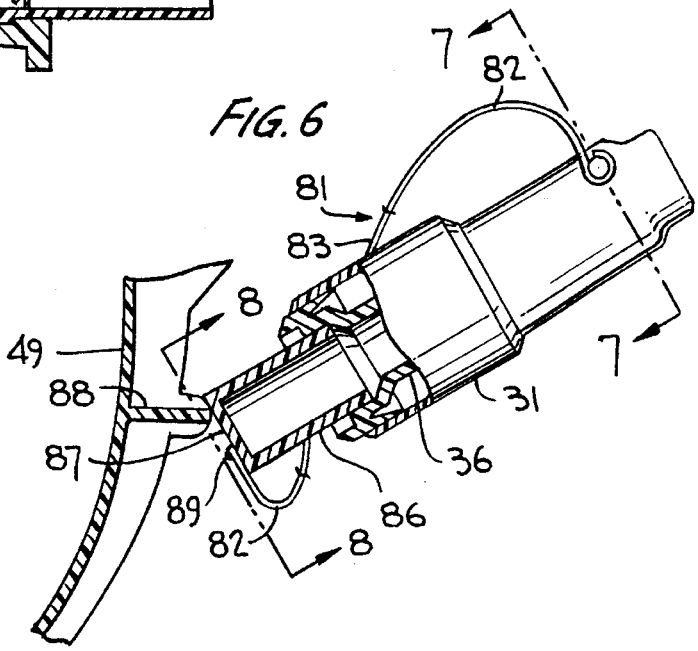
FIG. 6 is a view similar to FIG. 1 showing a portion of the dispenser incorporating an external piston return spring.
Figure 7:
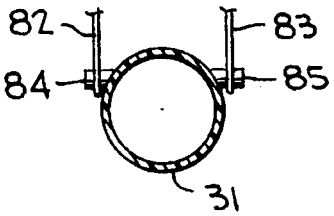
FIG. 7 is a view taken substantially along the line 7—7 of FIG. 6.
Figure 8:
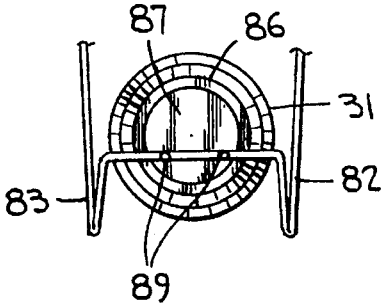
FIG. 8 is a view taken substantially along the line 8—8 of FIG. 6.

The internal wet spring 42 of the FIG. 1 embodiment can be replaced by an external dry spring for resiliently urging the piston out of the pump chambers. Reference is made to FIGS. 6, 7 and 8 showing such an alternative return spring in the form of a torsion spring 81 having a pair of spring legs 82,83 anchored at the free ends thereof at some convenient location on the pump body such as to studs 84,85 extending outwardly of cylinder 31. A tubular or the like extension 86 is press-fitted or is otherwise secured within the outer end of piston 36, the extension having an outer end wall 87 which, in the outboard position of the piston shown in FIG. 6, bears against a stiffening rib 88 of trigger lever 49.

Spring 81 has a bight portion 89 secured to end wall 87, legs 82,83 extending from the bight portion along opposite sides of extension 86 and along opposing sides of cylinder 31 for engagement with their respective studs 84,85.

During each pressure stroke of the piston exerted during each pull on the trigger, spring force is effectively stored by the torsion spring to act in positively retracting the piston out of its cylinder during each pumping return stroke. The abutting engagement between end wall 86 and rib 88 likewise returns the trigger lever to its initial position of FIG. 6.

It should be noted that the trigger lever is neither coupled to piston extension 86 nor to torsion spring 81, but rather the spring positively retracts the piston from its bore and returns the piston to its initial position as the piston extension simply pushes back on the trigger lever. With this arrangement, couplers need not be provided between the spring and the trigger lever or between the trigger lever and the piston extension, thereby avoiding additional costs in assembly and parts.

From the foregoing it can be seen that a simple and economical yet highly effective fluid dispenser is provided for simultaneously dispensing disparate fluids by simultaneously pumping the two fluids which remain separated during pumping and along the discharge path to a common location such as at the discharge nozzle end or downstream of the nozzle cap. The single pump cylinder having in-line pump chambers provided in carrying out the invention maintains the disparate fluids separated during pumping. Depending on the relative volume sizes of the in-line pump chambers, equal or relatively unequal amounts of the disparate fluids can be effectively pumped and discharged in a simple and effective manner without the need for elaborate control devices.

The vent control feature of the invention assures against leakage of fluids from the container compartments during shipping and storage as the vent control ring is effectively locked in a vent closed position by a connected trigger immobilizing bar which provides a child-resistant feature. Upon removal of the bar, the vent control ring is simply rotated into its vent opening position in readiness for pumping.

The vent control feature is not limited to the vent control of a dual compartment dispenser, but is equally applicable for use in the vent control of a single compartment dispenser as well, without departing from the invention. The child-resistant feature of the invention is likewise readily adaptable for use with a single compartment dispenser.

The piston return spring can be arranged as a wet spring or a dry spring, the latter being designed to effectively extract the piston along its bore during each piston return stroke without the need for coupling between the spring and the trigger lever or between the trigger lever and the piston extension.

Obviously, many other modifications and variations of the present invention are made possible in the light of the above teaching. It is therefore to be understood that within the scope of the appended claims the invention may be practiced otherwise than as specifically described.

What is claimed is:

1. A manually actuated fluid pump dispenser for simultaneously dispensing first and second fluids separately stored in respective first and second fluid compartments, comprising:

a pump body having pump means in fluid communication with said fluid compartments for simultaneously suctioning fluid therefrom and for discharging the suctioned fluid to a common location;

said pump means comprising a single pump cylinder and a single pump piston of unitary molded plastic construction reciprocable as a unit within said cylinder;

said piston having a pair of axially spaced piston seals defining with said cylinder a pair of axially aligned variable volume pump chambers; and actuation means on said pump body for actuating said piston against the force of a single piston return spring.

2. The dispenser according to claim 1, wherein said pump chambers have fluid inlets respectively communicating with said fluid compartments, and said pump chambers having fluid outlets respectively opening into a pair of separate discharge passages located in said pump body for discharging fluid to the common location.

3. The dispenser according to claim 2, wherein said pump body has a nozzle containing a single fluid spin mechanics assembly and a nozzle cap surrounding said nozzle and having a single discharge orifice, said passages opening into said spin mechanics assembly at which the first and second fluids are united before exiting said orifice as a spray.

4. The dispenser according to claim 3, wherein said fluid spin mechanics assembly includes a spinner probe defining together with said nozzle cap longitudinal channels leading to a spin chamber via tangential channels, said longitudinal channels communicating with said discharge passages.

5. The dispenser according to claim 3, wherein said fluid spin mechanics assembly includes a spinner probe defining together with said nozzle cap at least one longitudinal channel leading to a spin chamber via tangential channels, said longitudinal channel communicating with one of said discharge passages, said probe having a longitudinal opening communicating with the other of said discharge passages and leading to said spin chamber and said tangential channels for varying the conicity of the spray issuing through said discharge orifice.

6. The dispenser according to claim 2, wherein said pump body has a nozzle containing a pair of separate fluid spin mechanics assemblies respectively communicating with said passages, a nozzle cap surrounding said nozzle and having separate discharge orifices associated with said separate fluid spin mechanics assemblies.

7. The dispenser according to claim 6, wherein each said fluid spin mechanics assembly includes a spinner probe defining together with said nozzle cap at least one longitudinal channel leading to a spin chamber via tangential channels, each said longitudinal channel respectively communicating with said discharge passages.

8. The dispenser according to claim 1, wherein said pump chambers are of equal fluid capacity to facilitate the pumping and dispensing of equal proportions of said fluids.

9. The dispenser according to claim 1, wherein said pump chambers are of relatively unequal fluid capacities to facilitate the pumping and dispensing of disproportionate amounts of said fluids.

10. The dispenser according to claim 1, wherein said pump body has a container vent opening for each of said fluid compartments, a control ring rotatably mounted on said pump body without axial movement and having means for blocking and unblocking said vent openings upon manual rotation of said ring.

11. The dispenser according to claim 10, wherein said blocking and unblocking means comprise a ring wall having apertures for misalignment and alignment with said openings upon ring rotation.

12. The dispenser according to claim 1, wherein said pump body has a container vent opening for each of said fluid compartments and a perforate vent control rotatably mounted without axial movement for blocking and unblocking said openings.

13. The dispenser according to claim 12, wherein said actuation means comprises a trigger lever pivotally mounted on said pump body, and child-resistant means on said ring for preventing trigger actuation and for locking said vent control ring in a vent opening blocking condition, said child-resistant means comprising a bar extending between said lever and said ring and being removably connected to said ring.

14. The dispenser according to claim 13, wherein said bar is removably connected at one end to said ring by frangible connecting ties, said bar being supported at its opposite end by an internal catch provided on said lever.

15. A trigger operated fluid dispenser, comprising:

a pump body for mounting with a closure cap at the upper end of a container of fluid;

said pump body having a neck portion including at least one valve controlled fluid inlet passage, said neck portion being engaged by said closure cap;

said pump body having pump means in fluid communication with said inlet passage;

a trigger lever actuator pivotally mounted to said pump body for actuating said pump means;

said neck portion having at least one vent opening for communication with the interior of the container;

a vent control ring surrounding said neck portion and being manually rotatable about a central axis thereof without movement along said axis;

said ring having a wall overlying said vent opening for blocking said opening in a non-use condition of the dispenser;

said wall of said ring having at least one aperture in alignment with said vent opening for unblocking said opening in a given rotative position of said ring; and means on said ring for locking said ring in said non-use position.

16. The dispenser according to claim 15, wherein said neck portion includes an annular shoulder containing said vent opening.

17. The dispenser according to claim 15, wherein said lock means comprise child-resistant means for preventing trigger actuation in said non-use condition.

18. The dispenser according to claim 17, wherein said child-resistant means comprises a bar extending between said lever and said ring and being removably connected to said ring to permit ring rotation to said given rotative position.

19. The dispenser according to claim 18, wherein said bar is removably connected at one end to said ring by frangible connecting ties, said bar being supported at its opposite end by an internal catch provided on said lever.

20. The dispenser according to claim 1, wherein said piston return spring is mounted within one of said pump chambers in engagement with said piston.

21. The dispenser according to claim 1, wherein said actuation means comprises a trigger lever pivotally mounted on said pump body and bearing against said piston, said piston return spring being connected to said piston and to said pump body external to said pump cylinder for extracting said piston outwardly of said cylinder to outwardly pivot said lever during each return stroke of said piston.

* * * * *